US008231000B2

(12) United States Patent
Gonzalez et al.

(10) Patent No.: US 8,231,000 B2
(45) Date of Patent: Jul. 31, 2012

(54) CONTENTS INDICATORS AND CONTAINER SYSTEM

(76) Inventors: Miguel Gonzalez, Miami Springs, FL (US); Veronica Gonzalez, Miami Springs, FL (US)

( * ) Notice: Subject to any disclaimer, the term of this patent is extended or adjusted under 35 U.S.C. 154(b) by 0 days.

(21) Appl. No.: 12/755,507

(22) Filed: Apr. 7, 2010

(65) Prior Publication Data

US 2011/0192856 A1 Aug. 11, 2011

Related U.S. Application Data

(60) Provisional application No. 61/302,125, filed on Feb. 6, 2010.

(51) Int. Cl.
*B65D 85/00* (2006.01)
*G09F 3/00* (2006.01)

(52) U.S. Cl. ..... 206/459.1; 40/306; 220/908

(58) Field of Classification Search ..... 206/459.1, 206/459.5, 767, 768; 40/306, 307, 312, 313; 220/908–911

See application file for complete search history.

(56) References Cited

U.S. PATENT DOCUMENTS

| | | | | | |
|---|---|---|---|---|---|
| 527,688 | A | * | 10/1894 | Hernsheim | 206/768 |
| 1,819,933 | A | * | 8/1931 | Watson | 206/807 |
| 2,206,866 | A | | 7/1940 | Fuller | |
| 2,659,486 | A | * | 11/1953 | Krupin | 40/312 |
| 3,099,381 | A | * | 7/1963 | Meyers | 206/459.5 |
| 3,300,083 | A | * | 1/1967 | Wright | 206/459.1 |
| 3,418,740 | A | * | 12/1968 | Gray | 40/313 |
| 3,494,499 | A | * | 2/1970 | Kramer et al. | 40/312 |
| 4,216,598 | A | | 8/1980 | Newbert | |
| 4,382,542 | A | | 5/1983 | Farris | |
| 4,432,462 | A | * | 2/1984 | Newkirk | 206/459.1 |
| D349,926 | S | | 8/1994 | Junge | |
| 5,377,821 | A | * | 1/1995 | Fierek | 206/459.5 |
| 5,388,759 | A | | 2/1995 | Barnes | |
| D446,379 | S | | 8/2001 | Taylor | |
| 6,588,134 | B1 | | 7/2003 | Perelli | |
| D480,115 | S | | 9/2003 | Boni | |
| 6,808,081 | B1 | * | 10/2004 | Citro | 220/908 |
| D508,957 | S | | 8/2005 | Jensen | |
| D581,985 | S | | 12/2008 | Spratt | |
| 2002/0063132 | A1 | | 5/2002 | Prins et al. | |
| 2004/0045856 | A1 | * | 3/2004 | Rhoades | 206/459.5 |

* cited by examiner

*Primary Examiner* — Bryon Gehman
(74) *Attorney, Agent, or Firm* — Espinosa/Trueba, PL; William R. Trueba, Jr.; Michael E. Tschupp

(57) ABSTRACT

A container indicator system having an internal surface and internal area for storage of materials and an external surface; and an indicator (swiveling arm, reflector, textile material, rubber, plastic, metal flag, sign) attached to the container. The indicator described is optionally a flexible material, a swiveling arm integrated with an axis and a swiveling arm without an axis, a reflector or combinations of the foregoing and even multiple combinations of the foregoing to indicate various states of the container. The indicator is attached to the internal or external surface of the container or in the case of the swiveling arm (using a mounting plate) that acts itself as an indicator a further indicator like a reflector, or flag is attached near its extreme external end. The indicator is moveable from the internal area of the container to an external area.

2 Claims, 3 Drawing Sheets

CONTENTS INDICATORS AND CONTAINER SYSTEM

CROSS REFERENCE TO RELATED APPLICATIONS

Priority is claimed from provisional application 61/302,125 filed Feb. 6, 2010.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the United States Patent and Trademark Office patent file or records, but otherwise reserves all copyrights whatsoever.

BACKGROUND (1) Field of the Invention

Relating to improvements in receptacles or containers having a plurality of items therein.

(2) Description of the Related Art

US Patent Citations

U.S. Pat. No. 6,588,134 discloses a hanging sign provided for displaying messages. The sign may include a pair of walls that face in generally opposite directions so that messages can be displayed in two general directions, and a hook for hanging the walls from a support, such as a handrail assembly or other stanchion. The sign also may be configured to hang from a door handle and include a single display panel angled to face a pedestrian approaching the door. The sign may have a cavity to provide for nesting of a plurality of similar signs. A method is disclosed for hanging a sign to provide information to pedestrians.

U.S. Pat. No. 5,388,759 discloses a signal device, secured to the door of a rural mailbox, shows that mail has been received. The device operates by opening a shutter to display the message, "MAIL," when the mail carrier opens the mailbox door. It operates by gravity and latches magnetically. The shutter opens as a Venetian blind when the weighted screen falls forward. The signal device is reset by pushing the reset tab. The device returns to the closed position by gravity. In the closed position the message, "NO MAIL," printed on the shutter, is displayed. Moving parts are contained in a weatherproof box with a transparent window. The messages, "MAIL," or "NO MAIL" are visible through the transparent window.

U.S. Pat. No. 4,382,542 discloses a signal flap (22) mounted on the exterior face of a mailbox door using a pair of hinges (24 and 26). The signal flap (22) rotates between first and second positions, and in the second position, indicia (42) is exposed to view indicating the presence of mail. A latch (28) secures the signal flap in the first position, and releases the signal flap to rotate to the second position in response to the opening of the mailbox door.

U.S. Pat. No. 4,216,598 discloses a wind proof door knob tag especially for use with exterior doors includes integral flexible detent tabs between the opening through which the door knob passes and the opening which conforms to the outside diameter of door knob shaft. The tabs are cammed outwardly upon downward pull over the knob shaft and snap back into position to hold the tag firmly in place on the door knob despite wind conditions, thereby to prevent being blown away. The tab is made of a polyolefin sheet but could be made of a vinyl sheet which at the thickness utilized, prevents unauthorized opening of locks by insertion of this tag between a door and its associated jamb.

U.S. Pat. No. 2,206,866 discloses a hanging type of edge-illuminated sign.

U.S. Pat. No. 581,985 discloses an ornamental design for a hanging sign.

U.S. Pat. No. 508,957 discloses an ornamental design for an identification tag for containers.

U.S. Pat. No. 480,115 discloses an ornamental design for a days of the week hanging sign set.

U.S. Pat. No. 446,379 discloses an ornamental design for a stop sign mailbox flag.

U.S. Pat. No. 349,926 discloses an ornamental design for a sign for dumpsters.

BRIEF SUMMARY OF THE INVENTION

A container indicator system discussed herein has a container having an internal surface and internal empty volume for storage of materials and an external surface; and an indicator (swiveling arm, reflector, flexible material, rubber, plastic, metal flag, sign, textile material) attached to the container. The container is of a square or oblong rectangular shape having four walls and a bottom integrated as one container along with a hinged cover; alternatively, the container may have one (circular container) or more walls (containers having curves and linear wall portions, or solely curved or solely linear walls) and a bottom integrated as one item and having a cover attached by a hinge. The walls of the container are made of a solid material and have internal and external surfaces; optionally the walls are hollow. The types of containers described herein include but are not limited to: a waste container, a freight container, a clothing container, a storage container, a food container, and a mail container. The container optionally has a device to cover the main opening of the container that is permanently attached or optionally not permanently attached. The indicator described is made up of one or more of: a textile material, a swiveling arm integrated with an axis, a swiveling arm without an axis, a reflector or combinations of the foregoing and even multiple combinations of the foregoing to indicate various states of the container. The indicator is attached to the external surface of the container or to the internal surface of the container or in the case of the swiveling arm, it likewise is attached to the internal or external surface but it optionally has a reflector, or flag attached near its extreme external end. A unique aspect of the teachings herein is that the indicator is moveable from the internal area of the container to an external area outside of the container and back again. Thus, a clear signal is give to a user as to a new state of the container.

Further taught herein is a swiveling arm that is mounted on a surface of the container through the use of a mounting plate attached to the surface of the container through the use of one or more fasteners. In a preferred embodiment this arm does not have an axis integral with it, rather, it simply uses the mounting plate and simple swiveling action on a bearing member (that is threaded through curved portions of the mounting plate and stopped by two end stops) to be stowed away internal to the container to indicate one state of the container and returned to its original external location to indicate another state of the contents of the container.

This arm in another embodiment has an axis integral with it and extending perpendicular from the plane of the swiveling arm and parallel to a container face. It is held to the mounting plate by an axis holder to hold the axis threaded from the swiveling arm and attached to the mounting plate through the use of one or more fasteners and topped off by an axis cover covering the axis holder by using physical compression and snugness of fitting. Also, a disk lock is integrated with the swiveling arm and in between the axis and a main body of the swiveling arm.

DETAILED DESCRIPTION OF THE INVENTION

Figure 1:
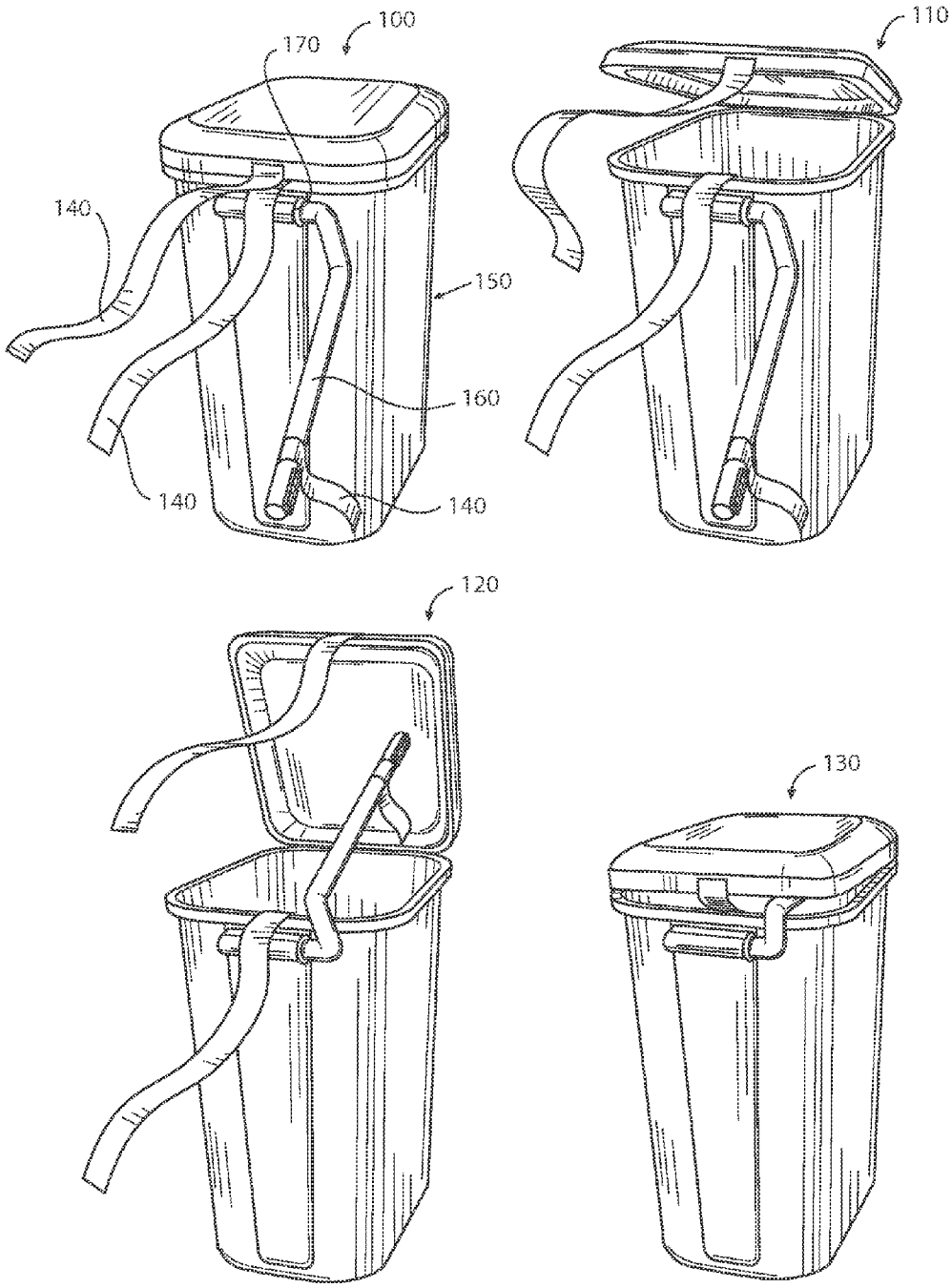
FIG. 1 illustrates various features of improvements in several stages of the opening, closing and operation of a storage container in one embodiment.
Figure 2:
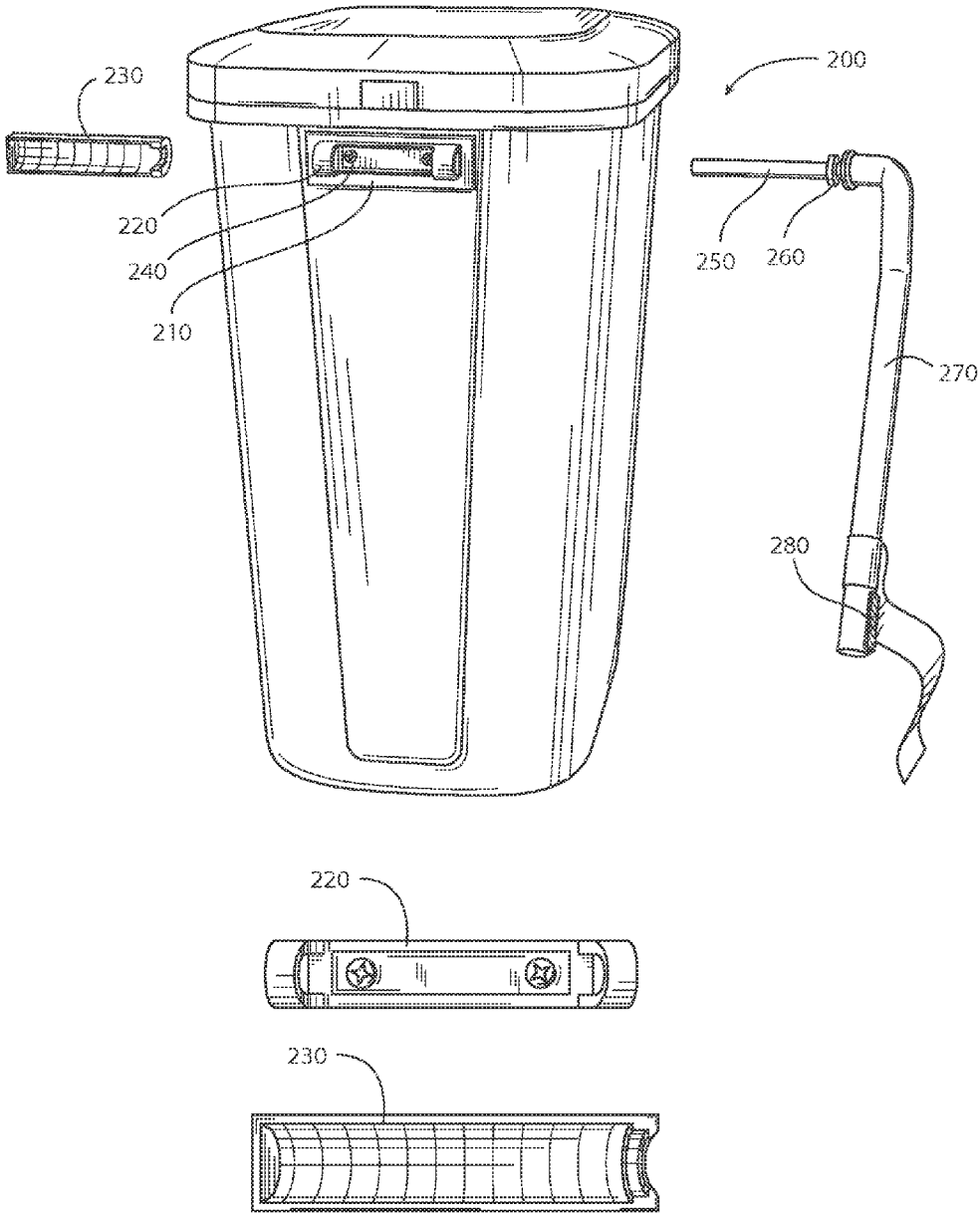
FIG. 2 illustrates an expanded view of improvements in storage containers having a variety of components in the embodiment of FIG. 1.

The following discussion of FIGS. 1-2 describes in detail a plurality of features in a first embodiment. FIG. 1 illustrates various features of improvements in several stages of a square or oblong rectangular storage container 150 having four walls and a bottom integrated as one container along with a hinged cover; alternatively, the container may have one (circular container) or more walls (containers having curves and linear wall portions) and a bottom integrated as one item and having a cover attached by a hinge. The walls of container 150 are made of a solid material and have internal and external surfaces; optionally the walls are hollow. This embodiment shows a container 150 in various stages 100, 110, 120 and 130 being opened, closed as well as being set in different modes of operation. View 100 illustrates the container in a totally closed state. Here are shown three strips 140 of a flexible textile material that indicate an operational status of the container. These strips 140 are attached through the use of glue, adhesive, or fasteners such as screws, nails, clips, bolts, washers, mounting plates, nuts or some combination of the foregoing; these strips attach to the lip of the door, the lip (internal or external) of the main body and near the end of an arm 160. This arm 160 swivels about in an assembly 170 and can be rotated back into the internal area of the container as shown in illustrations 110, 120 and 130. At the end of the arm is shown a reflector or light that reflects using plastic, metallic materials or is attached to a battery power source for electronic light signaling.

Illustration 100 is followed by the start of the container 150 being opened in 110. Next, view 120 shows a further motion by a user of the door into an open state so that the arm 160 can be stowed away into the container 150. Additionally, a user places the several strips 140 within the body of the storage container 150 and the door is closed over the arm 160 and strips 140 such that they are substantially enclosed inside the body of container 150. Thus, are shown the three main modes of operation of container 150. The first shown in view 100 describes a state by which the indicator strips 140 and arm 160 are completely deployed with maximum exposure to the outside of the container 150 for an indication of the internal state of container 150. The second mode of operation is generally described in views 110-120 where a user will open the container 150 door and stow away the indicator strips 140 and arm 160. The final mode of operation is shown in view 130 wherein the strips 140 and arm 160 are shown with least exposure to the outside of the container for an indication of the internal state of the container 150.

The first and last modes of operation are referred to as the flag or indicator modes of operation. These two modes signal to a user, in a waste receptacle example, a trash collector, that the container 150 is empty or full. It should be appreciated that the devices employed to distinguish this, namely, the strips 140, arm 160 and reflector are useable in any combination deleting or adding one or the other depending upon the implementation so desired. Also, the meaning of the indication itself is dependent upon user preferences. For example, the extension of the arm 160, strips 140 and reflector outside the container 150 in one implementation mean that it is empty; whilst the stowing away of the arm 160, the strips 140 and the reflector mean that the container is full. Of course the opposite system is useable in that the stowing away of the various flags indicates that the container 150 is empty; whilst the deployment of the indicators strips 140, reflector and arm 160 outside in full view shows to a user that there are materials to be picked up inside the container. Also, the deployment outside of or retracting of inside of the container 150 of individual or combinations of the two strips 140 and arm/strip/reflector 160 indicate different things depending upon user desires such as paper only, metal only, plastic only, newspaper only, biological only, recyclables only, or combinations of the foregoing are indicated by the display or lack of display of the aforementioned strips 140 and arm 160 and further indicate the state such as empty, full or partially full. All of these would be chosen at the localities where the system is used and may even include color-coded strips and arm so as to facilitate the collection of materials.

In these figures, the particular container shown is a waste receptacle; however, the teachings herein are applicable to any number of containers including but not limited to: waste, mail, food, crates, freight, box, clothing containers and more generally a device designed to contain a plurality of items through the use of a door that opens and closes. The particular layout of the door on the top of the device is also only shown for this particular implementation; however, the features taught herein are applicable for other containers that have their door on the front face, side faces, back face or arranged in some other fashion applicable to the unique characteristics of its utility. Further, whilst the diagrams and descriptions herein have assumed a hinge item being attached to the door and body of container 150 so as to facilitate easy motion of the door, it should be appreciated that a hinge is an optional device added to the system. In other words, the teachings herein are easily applicable to containers that do not use hinges such that the door can be easily and completely removed (by a user), the indicator materials 140 and swiveling arm 160 stowed away and the return of the door or cover (by a user) unto the container body; non-door containers are also contemplated.

FIG. 2 illustrates an expanded view of the improvements in storage containers that were shown in FIG. 1. View 200 shows the container body and cover as well as mounting plate 210, axis holder 220, axis cover 230, screws 240, axis 250, disk lock 260, arm 270 and reflector 280. To facilitate the swiveling motion of arm 270 about axis 250 an axis holder 220 is used. Axis holder 220 is an oblong device with two circular extensions that come out from its main body; these circular extensions have circular openings to permit the entry of axis 250 into them. A user slips this axis 250 into these two circular extensions until reaching disk lock 260 that is larger than the circular openings of axis holder 220; thus, the user is prevented from further threading the axis 250 into the axis holder 220. At this point, the user covers the axis 250 and holder 220 with an axis cover 230.

This cover 230 is an oblong device that generally corresponds to the dimensions of the axis holder 220 but is a somewhat bigger so as to enclose the holder in a snug fit. One end of the cover 230 is closed whilst the other end has a circular opening to permit the threading of the axis 250 into it. The axis 250 is also locked into place through the use of a disk lock 260. This disk lock 260 is of a diameter larger than the axis 250, larger than the circular openings found in holder 220 and the one found in cover 230. So that once the axis 250 has been threaded through the two circular openings in the holder 220, the forward motion of threading the axis 250 stops and the cover 230 is placed by a user into a snug fitting over holder 220, axis 250 and locked into place by locking disk 260.

Arm 270 has two elbows that correspond generally to the axis that runs parallel to the lip of the container door/face to the twist (1—first elbow) in to an up to down portion and another that blocks further downward motion of the arm such that it proceeds from an up to down portion of the arm 270 to the twist (2—second elbow) to the extended portion of the arm that extends out into space and ends in a reflector 280 and indicator strip. Depending upon the configuration of the angle of the second elbow the arm 270 is extendible at any angle from straight down and parallel (zero degree orientation) to the face of the container containing the mounting plate 210 to completely perpendicularly to the surface containing mounting plate 210 until parallel and straight up orientation (180 degree orientation) and all angles there between.

It should be noted that due to the intrinsic angles and distances that are created by the mounting and locations of the plate 210, holder 220, axis 250, and arm 270 a certain amount of built in backward overhang is created as shown in the drawings such that the arm 270 rests somewhat setback against the container 200 face. Thus, care should be taken to understand the teachings herein that the angle discussed above as the zero to ninety to 180 degree orientation of the arm 270 should be viewed as the resulting angle of the hanging of the arm 270 against the container face and not the angle of the elbow itself with respect to the up and down portion of the swiveling arm.

Of course, this angle is the external angle for signaling the state of the container and does not relate to the other mode of operation relating to the internal stowing away of the swiveling arm. In fact the arm may be even further extended as far as 270 degrees from the original face.

Figure 3:
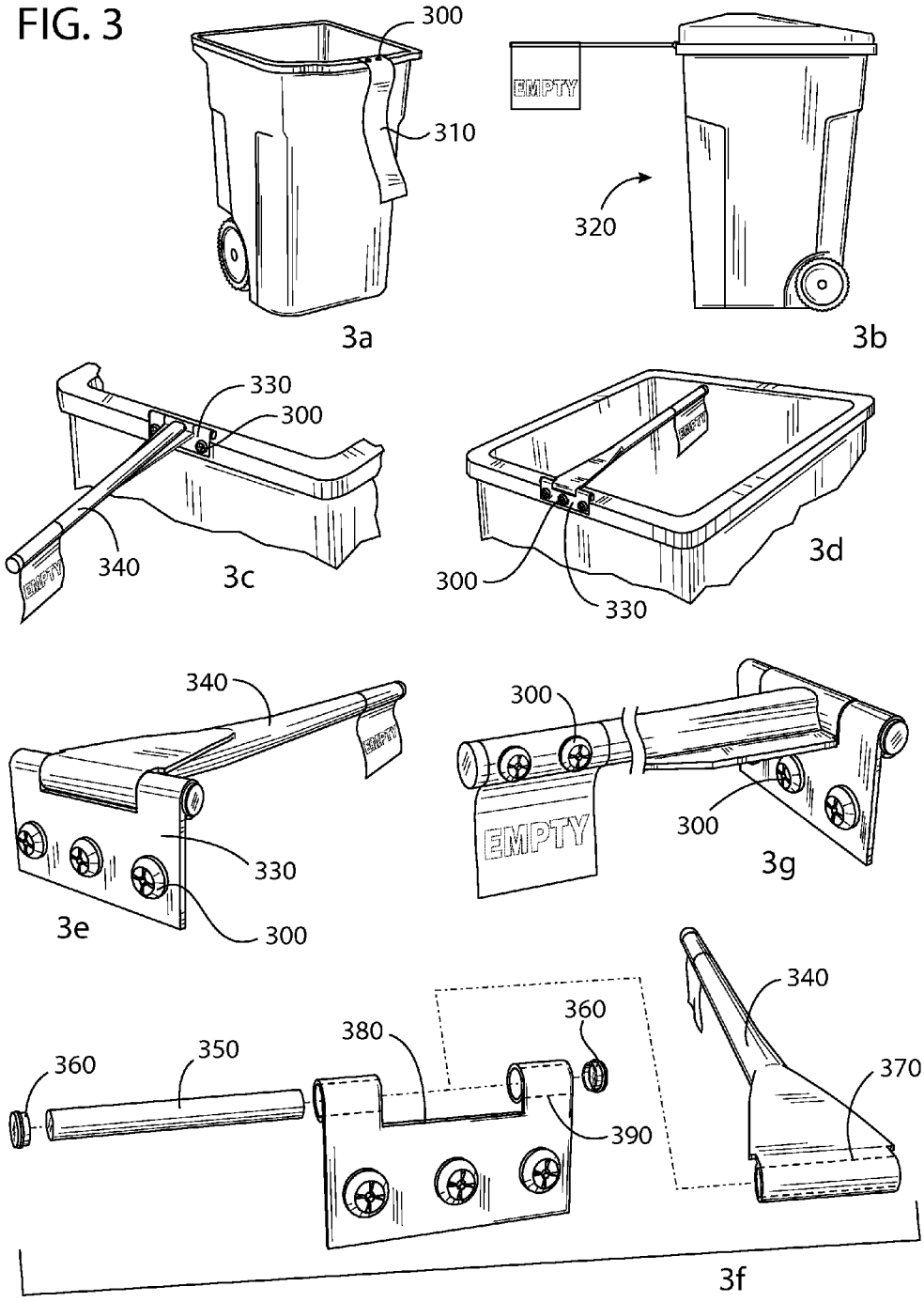
FIG. 3 illustrates various features of improvements in storage containers in various embodiments including a preferred embodiment.

The following discussion of FIG. 3 describes in detail a plurality of features in various embodiments including an alternative embodiment and a preferred embodiment.

Items 300 represent fasteners in several views in this case screws that are used to attach various items to a container. The fasteners 300 whilst represented as screws are replaceable with a variety of fasteners including but not limited to screws, nails, glues, adhesives, nuts, washers and combinations of the foregoing. In FIG. 3A a flexible material 310 is attached in one view by fasteners 300 and is draped outside the container to signify the internal condition (empty, full, some other specific capacity or contents type) of the container. To signify another internal condition (empty, full, some other specific capacity or contents type) the flexible material is stowed away internal to the container. The flexible material 310 is a material that can resist atmospheric and possible toxic contents of the container, typically a durable textile material, rubber, or plastic, polymer or some other similar material that is flexible and resistant to the needs of the implementation.

DETAILED DESCRIPTION OF THE PREFERRED EMBODIMENT

The following is a detailed description of the preferred embodiment.

In FIG. 3B drawing 320 illustrates a container having an indicator that shows a deployed sign signifying the internal condition of the container. It should be noted that whilst the container's contents are shown to be 'EMPTY' the flag is able to have any warning sign, identifying information such as city, county, state, zip information and is alternatively color coded to be better observable. In FIG. 3C item 330 shows a mounting plate that is used to attach a ball bearing hinge and swiveling arm 340 that is hollow or solid through the use of fasteners 300 to a container. The mounting plate 330 is attached to a face of the container such that the fasteners are threaded through the holes in the mounting plate designed to receive them. The fasteners 300 whilst represented as screws are replaceable with a variety of fasteners including but not limited to screws, nails, glues, adhesives, nuts, washers and combinations of the foregoing. The screws 300 are threaded through the holes in the mounting plate 330 and further through the surface of the container. If a better attachment is required then nuts may be used on the opposite side of the container surface to secure the screws; washers are optional to provide support on one or both sides if so desired. Also, another mounting plate that is similar in size to 330 but without the connections to a ball bearing hinge is optionally available on the other side of the container's surface and receives the passage of the screws, optional nut and or washer if so desired. It should be noted that the hinge and arm are preferably integrated into one unit but are optionally separated into two units an arm and a hinge unit. The arm and hinge would be attachable to each other by welding, adhesives, glues, and or fasteners (screws, nails, bolts, washers, nuts, clips, general fasteners). Finally, drawing 3D shows the stowing away of the hinge arm inside of container. Depending upon the location of the mounting plate 330 the thickness of the container, the inherent stopping action of the hinge arm against the mounting plate as well as the thickness of the mounting plate 330 itself, the hinge arm 340 rests in various angles inside of the container.

FIG. 3E illustrates an expanded perspective of mounting plate 330, fasteners 300 and hinge arm 340 that are to be attached to a container lip. A bearing member 350 is to be threaded through a passageway found at one end of hinge arm 340 and resting in cavities on either side of the central location of mounting plate 330. Thus, the hinge arm 340 rotates on a bearing member and is able to be easily moveable on the same.

FIG. 3F further illustrates the bearing member 350, an integral hinge and arm 340 as well as a mounting plate 330. The bearing member is a cylindrical (hollow) or circular rod (solid) long enough to pass one mounting plate cavity through a circular passageway at the end of the integral hinge arm 340 and enter the other circular cavity of the two found at either end of the mounting plate as viewed from the center of the mounting plate looking to the right or left on the figure. Thus, the bearing member 350 holds the hinge arm 340 in place and prevents disengagement of the hinge arm from the mounting plate 330 and permits rotation of the hinge arm on the bearing member 350. Additionally, two mounting plate caps 360 are shown in the drawing and enter from either end of the two circular cavities found on both the right and left side of the mounting plate 340. These caps are welded or forced in place by physical pressure. Finally, integral hinge and arm is shown with an internal circular passageway 370 to permit the insertion of bearing member 350. Whilst shown in a somewhat triangular fashion it optionally takes the shape of a regular polygon bar such that its circumference takes on the shape of said regular polygon, circular rod or some other simple shape that may be solid or hollow depending upon the implementation.

FIG. 3G illustrates the general location of a contact point near the location of the circular passageways 370 of hinge arm 340 as it extends outside of the container. The hinge arm 340 impacts the edge 380 shown in FIG. 3F at roughly point 370 thus stopping any further motion of the hinge arm 340. The sign representing an operational mode in this case 'EMPTY' (FULL, Color coded, day, recyclables only, biodegradable, metals, cardboards are optional signs). Further, the indicator sign itself is made from a textile material that is fastened to hinge arm 340 with fasteners, adhesives, glues or in the case that the material is a metallic rigid sign welded to the hinge arm 340. Of course if fasteners like screws and nuts are used then appropriate holes must exist for the passage of such items in order to secure the indicator sign.

In these figures, the particular container shown is a waste receptacle; however, the teachings herein are applicable to any number of containers including but not limited to: waste, mail, food, crates, freight, box, clothing containers and more generally a device designed to contain a plurality of items through the use of a door that opens and closes. The particular layout of the door on the top of the device is also only shown for this particular implementation; however, the features taught herein are applicable for other containers that have their door on the front face, side faces, back face or arranged in some other fashion applicable to the unique characteristics of its utility. Further, whilst the diagrams and descriptions herein have assumed a hinge item being attached to the door and body of container so as to facilitate easy motion of the door, it should be appreciated that a hinge door combination is an optional device added to the system. In other words, the teachings herein are easily applicable to containers that do not use a door with a hinge such that the door can be easily and completely removed (by a user), the indicator materials and swiveling hinge arm stowed away and the return of the door or cover (by a user) unto the container body; optionally, no cover or door is used. The container shown in FIG. 3 is a square or oblong rectangular storage container having four walls and a bottom integrated as one container along with a hinged cover; alternatively, the container may have one (circular container) or more walls (containers having curves and linear wall portions) and a bottom integrated as one item and having a cover attached by a hinge. The walls of the container are made of a solid material and have internal and external surfaces; optionally the walls are hollow.

The fasteners taught herein, namely, screws, fasteners, glues, adhesives, nuts, bolts, nails, washer, clips are to be thought of as creating a permanent attachment to the various attachment areas and are comprised from various types of materials including metals, metallic alloys, and more. The bearing member, mounting plates, and swiveling arm are comprised of metals, metallic alloys, alnico, stainless steel, plastics, pvc cellulose based plastic, bakelite, polystyrene, nylon, rubbers and combinations of the foregoing. The indicator strips comprise the typical materials produced from animal (Wool, Silk), plant (Cotton, Flax, Jute), mineral (Asbestos), and synthetic (Nylon, Polyester, Acrylic) sources. The containers themselves may be similarly made of metals, metallic alloys, plastics, pvc, cellulose based plastic, bakelite, polystyrene, nylon, rubbers or combinations of the foregoing.

We claim:

1. An indicator system comprising:

a disposal container having an upwardly oriented opening provided with a lid;

a first elongated, textile flexible indicator strip having two ends, a first end of said first indicator strip fastened to the container near the upwardly oriented opening;

a second elongated, textile flexible indicator strip having two ends, a first end of said second indicator strip fastened to the lid of the container;

an elongated arm having a first end and a second end, said first end of said arm hingedly coupled to a mounting bracket, said mounting bracket fastened to the container near the upwardly oriented opening such that the arm is capable of rotating from one position wherein part of said arm including said second end is inside the container to a second position wherein part of said arm including said second end is outside the container;

a third elongated, textile flexible indicator strip having two ends, a first end of said third indicator strip attached near said second end of said arm;

wherein said first, second and third flexible indicator strips are capable of being placed substantially inside the container in one position of the indicator system and substantially outside the container in another position of the indicator system.

2. A method of providing indication whether a disposal container needs to be emptied, the method comprising:

providing a disposal container having an upwardly oriented opening and a lid;

fastening a first end of a first elongated, textile flexible indicator strip having two ends to the container near the upwardly oriented opening;

fastening a first end of a second elongated, textile flexible indicator strip having two ends to the lid;

fastening a mounting bracket to the container near the upwardly oriented opening, said bracket hingedly coupled to an elongated arm having a first end and a second end;

fastening a third elongated, textile flexible indicator strip to near said second end of said arm;

rotating said arm from one position wherein part of said arm including said second end is outside the container to a second position wherein said part of said arm including said second end is inside the container so as to indicate whether the container needs to be emptied; and placing at least a portion of said first, second and third indicator strips into the disposal container so as to indicate whether the container needs to be emptied.

* * * * *